US008814619B2

(12) United States Patent
Maekawa et al.

(10) Patent No.: US 8,814,619 B2
(45) Date of Patent: Aug. 26, 2014

(54) OUTBOARD MOTOR AND METHOD FOR MANUFACTURING OUTBOARD MOTOR

(75) Inventors: Shinya Maekawa, Shizuoka (JP); Toshio Suzuki, Shizuoka (JP); Koichi Nakayama, Shizuoka (JP); Katsumi Ochiai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 167 days.

(21) Appl. No.: 13/360,953

(22) Filed: Jan. 30, 2012

(65) Prior Publication Data

US 2013/0029545 A1 Jan. 31, 2013

(30) Foreign Application Priority Data

Feb. 2, 2011 (JP) ..... 2011-021073

(51) Int. Cl.
*B63H 21/00* (2006.01)

(52) U.S. Cl.
USPC ..... 440/89 R; 440/89 H

(58) Field of Classification Search
USPC ..... 440/89 R, 89 H; 60/302, 299
See application file for complete search history.

(56) References Cited

U.S. PATENT DOCUMENTS

| | | | | | |
|---|---|---|---|---|---|
| 5,306,185 | A * | 4/1994 | Lassanske et al. | ..... | 440/89 R |
| 5,346,417 | A * | 9/1994 | Isogawa | ..... | 440/89 R |
| 5,372,530 | A * | 12/1994 | Holtermann et al. | ..... | 440/89 R |
| 5,494,467 | A * | 2/1996 | Sohgawa et al. | ..... | 440/89 R |
| 5,637,792 | A | 6/1997 | Kimura et al. | | |
| 5,743,774 | A * | 4/1998 | Adachi et al. | ..... | 440/89 R |
| 6,283,809 | B1 * | 9/2001 | Takase et al. | ..... | 440/89 R |
| 6,662,555 | B1 * | 12/2003 | Ishii | ..... | 60/302 |
| 6,729,921 | B1 * | 5/2004 | Ishii | ..... | 440/89 H |
| 6,884,133 | B2 * | 4/2005 | Ishii | ..... | 440/89 H |
| 7,867,048 | B2 * | 1/2011 | Ochiai | ..... | 440/89 H |
| 8,261,541 | B2 * | 9/2012 | Takewaki | ..... | 60/302 |
| 2009/0094965 | A1 * | 4/2009 | Takewaki | ..... | 60/299 |
| 2010/0240269 | A1 | 9/2010 | Ochiai | | |
| 2010/0240270 | A1 | 9/2010 | Ochiai | | |
| 2013/0029545 | A1 * | 1/2013 | Maekawa et al. | ..... | 440/89 H |

FOREIGN PATENT DOCUMENTS

| | | | |
|---|---|---|---|
| JP | 08-207892 | A | 8/1996 |
| JP | 09-049424 | A | 2/1997 |
| JP | 2009-097371 | A | 5/2009 |
| JP | 2010-216452 | A | 9/2010 |
| JP | 2010-242744 | A | 10/2010 |

* cited by examiner

*Primary Examiner* — Lars A Olson
*Assistant Examiner* — Jovon Hayes
(74) *Attorney, Agent, or Firm* — Keating & Bennett, LLP

(57) ABSTRACT

An outboard motor includes an engine, an exhaust manifold, and a lower exhaust passage. The engine includes a plurality of cylinders, and a plurality of exhaust ports. The cylinders are disposed in-line in a vertical direction. The exhaust ports are respectively connected to the cylinders. The exhaust manifold includes a first passage, a second passage, and a third passage. The first passage is connected to the exhaust ports, and extends in a vertical direction. The second passage is connected to the first passage. The third passage is connected to the first passage below the second passage. The lower exhaust passage is connected to the exhaust manifold, and provides a passage through which exhaust gas is expelled to the outside from the exhaust manifold. One of the second passage and the third passage is connected to the lower exhaust passage.

14 Claims, 17 Drawing Sheets

OUTBOARD MOTOR AND METHOD FOR MANUFACTURING OUTBOARD MOTOR

BACKGROUND OF THE INVENTION

1. Field of the Invention

The present invention relates to an outboard motor and to a method for manufacturing an outboard motor.

2. Description of the Related Art

In recent years outboard motors have come to be equipped with catalysts for cleaning exhaust gas. For example, Japanese Laid-open Patent Application 2009-97371 discloses a catalyst disposed in a U-shaped exhaust passage. Because this U-shaped exhaust passage is removable, the catalyst can readily be extracted by removing the U-shaped exhaust passage. Japanese Laid-open Patent Application 9-49424 discloses forming a catalyst chamber midway along an exhaust passage, and disposing a catalyst in the catalyst chamber. A portion of the exhaust passage is demarcated as an exhaust passage cover, which is detachably attached to another section of the exhaust passage. Because of this, the catalyst is readily removed by removing the exhaust passage cover.

However, not all outboard motors are equipped with a catalyst, and even for outboard motors equipped with the same model of engine, the decision as to whether to include a catalyst is made according to whether exhaust cleaning capability is considered more important, or other factors such as weight are considered more important. For example, if exhaust cleaning capability is considered more important, a catalyst-equipped model will be required, whereas if weight considerations are more important, a non-catalyst-equipped model will be required. In the latter case, if the catalyst is removable as in the outboard motors disclosed in the aforedescribed documents, by removing the catalyst the weight can be reduced by the equivalent of the weight of the catalyst. However, in the outboard motors disclosed in the aforedescribed document, the catalyst is simply removable temporarily for the purpose of maintenance and the like, and the structure of the exhaust pipe remains the same even with the catalyst removed. Because of this, while it is possible to reduce weight by the equivalent of the weight of the catalyst, additional reduction in weight is desirable.

Also, in catalyst-equipped models, the catalyst is disposed along the path of the exhaust pipe. Because of this, the exhaust pipe of a catalyst-equipped model has a more complex shape than that of a non-catalyst-equipped model, and the exhaust pipe is greater in length. Consequently, simply removing the catalyst from a catalyst-equipped model does not sufficiently reduce weight. Because of this, in conventional outboard motors, in cases where further reduction in weight is desired, it will be necessary to adopt different exhaust pipe structures for catalyst-equipped models versus non-catalyst-equipped models, which makes it difficult to utilize the same engine in common.

SUMMARY OF THE INVENTION

Preferred embodiments of the present invention provide an outboard motor in which the same engine can be used in common for both a catalyst-equipped model and a non-catalyst-equipped model, and by which the weight when no catalyst is provided can be reduced appreciably as compared with that when a catalyst is provided.

The outboard motor according to a preferred embodiment of the present invention includes an engine, an exhaust manifold, and a fourth passage. The engine includes a plurality of cylinders, and a plurality of exhaust ports. The plurality of cylinders are disposed in-line in a vertical direction. The plurality of exhaust ports are respectively connected to the cylinders. The exhaust manifold includes a first passage, a second passage, and a third passage. The first passage is connected to the plurality of exhaust ports, and extends in a vertical direction. The second passage is connected to the first passage. The third passage is connected to the first passage below the second passage. The fourth passage is connected to the exhaust manifold, and serves as a passage through which exhaust gas is expelled to the outside from the exhaust manifold. One of the second passage and the third passage is connected to the fourth passage, while the other of the second passage and the third passage is subjected to a process for impeding flow of exhaust gas.

A method for manufacturing an outboard motor according to another preferred embodiment of the present invention is a method for manufacturing an outboard motor comprising an engine, an exhaust manifold, and a fourth passage. The engine includes a plurality of cylinders, and a plurality of exhaust ports. The plurality of cylinders are disposed in-line in a vertical direction. The plurality of exhaust ports are respectively connected to the cylinders. The exhaust manifold includes a first passage, a second passage, and a third passage. The first passage is connected to the plurality of exhaust ports, and extends in a vertical direction. The second passage is connected to the first passage. The third passage is connected to the first passage below the second passage. The fourth passage is connected to the exhaust manifold, and serves as a passage through which exhaust gas is expelled to the outside from the exhaust manifold. The method for manufacturing an outboard motor includes the following steps. In a first step, one of the second passage and the third passage is connected to the fourth passage. In a second step, the other of the second passage and the third passage is subjected to a process for impeding flow of exhaust gas.

An outboard motor according to yet another preferred embodiment of the present invention includes an engine, an exhaust manifold, and a fourth passage. The engine includes a plurality of cylinders, and a plurality of exhaust ports. The plurality of cylinders are disposed in-line in a vertical direction. The plurality of exhaust ports are respectively connected to the cylinders. The exhaust manifold includes a first passage, a second passage, and a third passage. The first passage is connected to the plurality of exhaust ports, and extends in a vertical direction. The second passage is connected to the first passage. The third passage is connected to the first passage. The fourth passage is connected to the exhaust manifold, and serves as a passage through which exhaust gas is expelled to the outside from the exhaust manifold. One of the second passage and the third passage is connected to the fourth passage, while the other of the second passage and the third passage is subjected to a process for impeding flow of exhaust gas.

In an outboard motor according to a preferred embodiment of the present invention, the plurality of exhaust ports are connected to the first passage. Because of this, exhaust gas from the engine amasses in the first passage. Also, the second passage and the third passage are connected to the first passage. Either the second passage or the third passage is connected to the fourth passage, while the other is subjected to a process for impeding flow of exhaust gas. Because of this, the path of the exhaust passage can be varied in length between the case where the second passage is connected to the fourth passage, versus the case where the third passage is connected to the fourth passage. Consequently, in a catalyst-equipped model of an outboard motor, by connecting either the second passage or the third passage, whichever passage affords an exhaust passage of greater path length, to the fourth passage, the path length necessary for the purpose of equipping a catalyst can be ensured. Also, in a non-catalyst-equipped model of an outboard motor, by connecting either the second passage or the third passage, whichever passage affords an exhaust passage of shorter path length, to the fourth passage, the degree to which the weight is reduced relative to the catalyst-equipped model equates not only to the weight of the catalyst, but the extent to which the exhaust passage is shortened. In the case where the second passage is connected to the fourth passage, the third passage is subjected to a process for impeding flow of exhaust gas. Conversely, in the case where the third passage is connected to the fourth passage, the second passage is subjected to a process for impeding flow of exhaust gas. Because of this, merely performing a simple process enables an engine to be utilized in common for both catalyst-equipped models and non-catalyst-equipped models. In this way, the outboard motor according to the present preferred embodiment permits utilization of an engine in common for both the catalyst-equipped model and the non-catalyst-equipped model, and allows the weight when a catalyst is not provided to be appreciably reduced as compared with when a catalyst is provided.

In a method for manufacturing an outboard motor according to another preferred embodiment of the present invention, the plurality of exhaust ports are connected to the first passage. Because of this, exhaust gas from the engine amasses in the first passage. Also, the second passage and the third passage are connected to the first passage. Either the second passage or the third passage is connected to the fourth passage, while the other is subjected to a process for impeding flow of exhaust gas. Because of this, the path of the exhaust passage can be varied in length between the case where the second passage is connected to the fourth passage, versus the case where the third passage is connected to the fourth passage. Consequently, in a catalyst-equipped model of an outboard motor, by connecting either the second passage or the third passage, whichever passage affords an exhaust passage of greater path length, to the fourth passage, the path length necessary for the purpose of equipping a catalyst can be ensured. Also, in a non-catalyst-equipped model of an outboard motor, by connecting either the second passage or the third passage, whichever passage affords an exhaust passage of shorter path length, to the fourth passage, the degree to which the weight is reduced relative to the catalyst-equipped model equates not only to the weight of the catalyst, but the extent to which the exhaust passage is shortened. In the case where the second passage is connected to the fourth passage, the third passage is subjected to a process for impeding flow of exhaust gas. Conversely, in the case where the third passage is connected to the fourth passage, the second passage is subjected to a process for impeding flow of exhaust gas. Because of this, merely performing a simple process enables the same engine to be utilized in common for both catalyst-equipped models and non-catalyst-equipped models. In this way, the method for manufacturing an outboard motor according to the present preferred embodiment permits utilization of an engine in common for both the catalyst-equipped model and the non-catalyst-equipped model, and allows the weight when no catalyst is provided to be appreciably reduced as compared with when a catalyst is provided.

In an outboard motor according to yet another preferred embodiment of the present invention, the plurality of exhaust ports are connected to the first passage. Because of this, exhaust gas from the engine amasses in the first passage. Also, the second passage and the third passage are connected to the first passage. Either the second passage or the third passage is connected to the fourth passage, while the other is subjected to a process for impeding flow of exhaust gas. Because of this, the path of the exhaust passage can be varied in length between the case where the second passage is connected to the fourth passage, versus the case where the third passage is connected to the fourth passage. Consequently, in a catalyst-equipped model of an outboard motor, by connecting either the second passage or the third passage, whichever passage affords an exhaust passage of greater path length, to the fourth passage, the path length necessary for the purpose of equipping a catalyst can be ensured. Also, in a non-catalyst-equipped model of an outboard motor, by connecting either the second passage or the third passage, whichever passage affords an exhaust passage of shorter path length, to the fourth passage, the degree to which the weight is reduced relative to the catalyst-equipped model equates not only to the weight of the catalyst, but the extent to which the exhaust passage is shortened. In the case where the second passage is connected to the fourth passage, the third passage is subjected to a process for impeding flow of exhaust gas. Conversely, in the case where the third passage is connected to the fourth passage, the second passage is subjected to a process for impeding flow of exhaust gas. Because of this, merely performing a simple process enables the same engine to be utilized in common for both catalyst-equipped models and non-catalyst-equipped models. In this way, the outboard motor according to the present preferred embodiment permits utilization of an engine in common for both the catalyst-equipped model and the non-catalyst-equipped model, and allows the weight when no catalyst has been provided to be appreciably reduced as compared with when a catalyst is provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
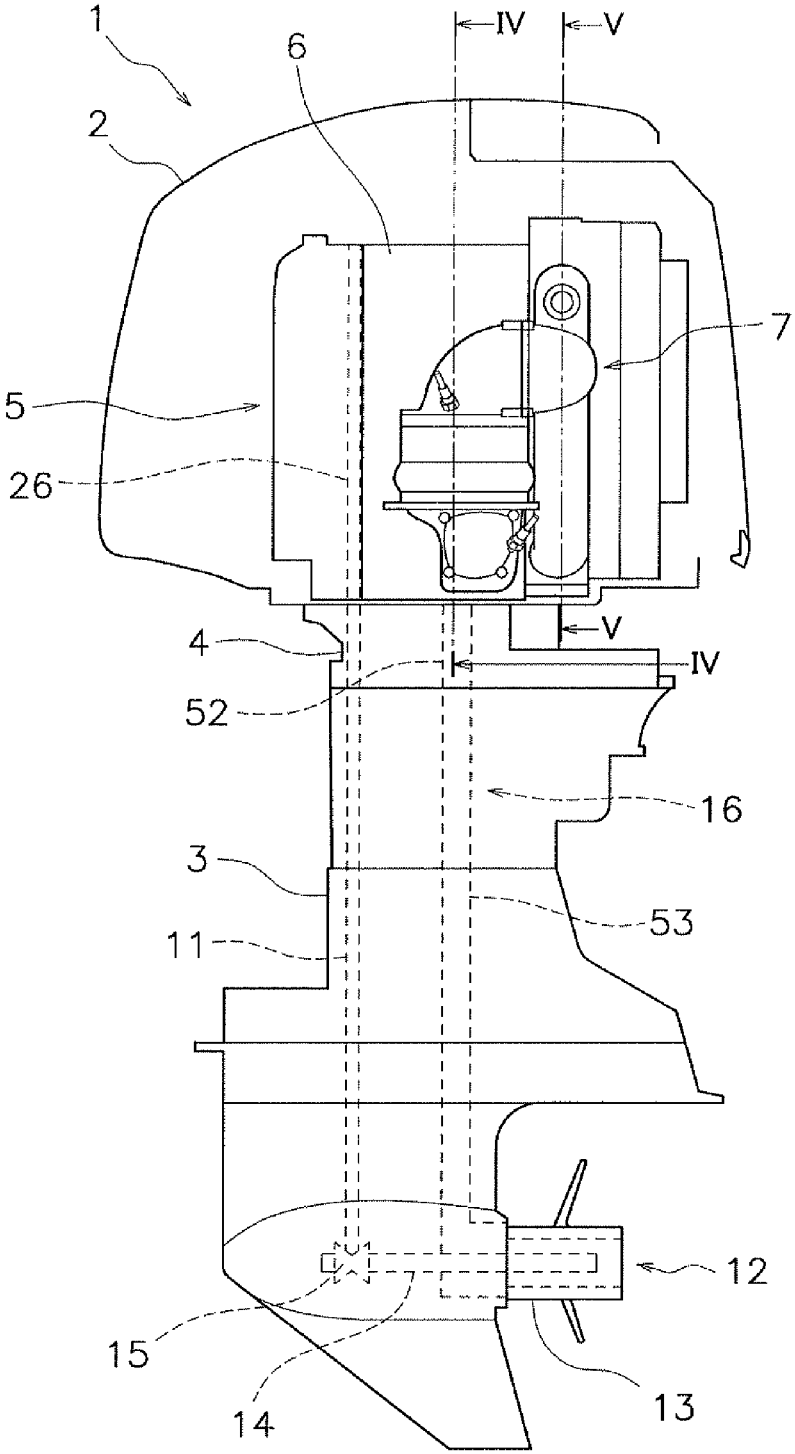
FIG. 1 is a side view of an outboard motor according to a preferred embodiment of the present invention.
Figure 2:
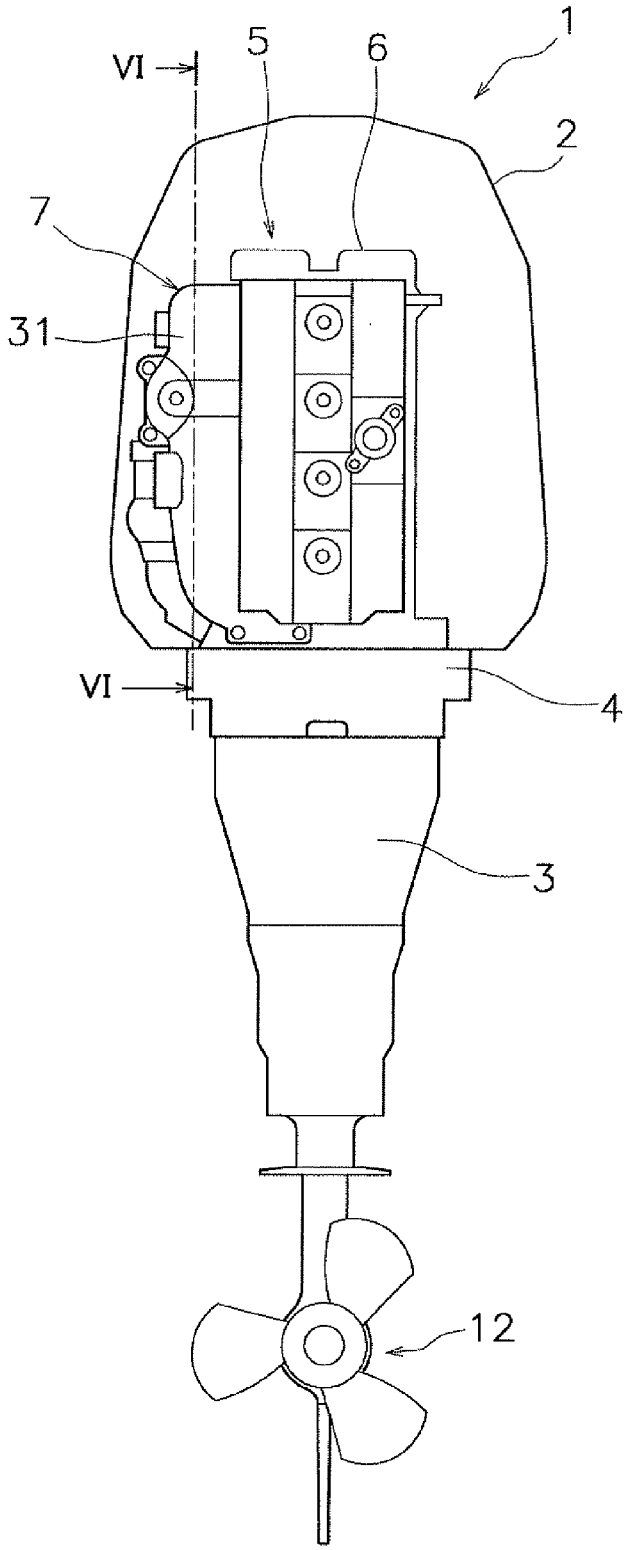
FIG. 2 is a rear view of the outboard motor according to a preferred embodiment of the present invention.

FIG. 1 is a side view depicting an outboard motor 1 according to a preferred embodiment of the present invention. FIG. 2 is a rear view depicting the outboard motor 1 according to a preferred embodiment of the present invention. As shown in FIGS. 1 and 2, the outboard motor 1 according to the present preferred embodiment includes an upper casing 2, a lower casing 3, an exhaust guide portion 4, and an engine unit 5. For ease of understanding, in FIGS. 1 and 2, the upper casing 2 is shown in cross section. The upper casing 2, the lower casing 3, and the engine unit 5 are fixed to the exhaust guide portion 4. The exhaust guide portion 4 supports the engine unit 5 and guides exhaust gas from the engine unit 5, and corresponds to a component called a mount case, an adapter plate, or the like.

The engine unit 5 is disposed inside the upper casing 2. The engine unit 5 includes an engine 6 and an exhaust manifold 7. As shown in FIG. 1, a drive shaft 11 is disposed inside the lower casing 3. The drive shaft 11 is disposed along a vertical direction inside the lower casing 3. The drive shaft 11 is fixed to a crankshaft 26 of the engine 6. A propeller 12 is disposed in the lower portion of the lower casing 3. The propeller 12 is disposed below the engine 6. The propeller 12 includes a propeller boss 13. A propeller shaft 14 is disposed inside the propeller boss 13. The propeller shaft 14 is disposed along a longitudinal direction. The propeller shaft 14 is linked to the lower portion of the drive shaft 11 via a bevel gear 15.

In the outboard motor 1, the drive force generated by the engine 6 is transmitted to the propeller 12 via the drive shaft 11 and the propeller shaft 14. The propeller 12 is thereby rotated forward or rotated in reverse. As a result, a propulsion force will be generated to cause the vessel to which the outboard motor 1 is attached to move forward or backward.

The outboard motor 1 also includes an exhaust passage 16. The exhaust passage 16 is arranged so as to extend from the engine 6 through the inside of the exhaust guide portion 4 and the inside of the lower casing 3 to reach the propeller boss 13 of the propeller 12. The exhaust gas expelled from the engine 6 is expelled into the water from the exhaust passage 16 through the internal space of the propeller boss 13. The configuration of the exhaust passage 16 will be described in detail later.

Figure 3:
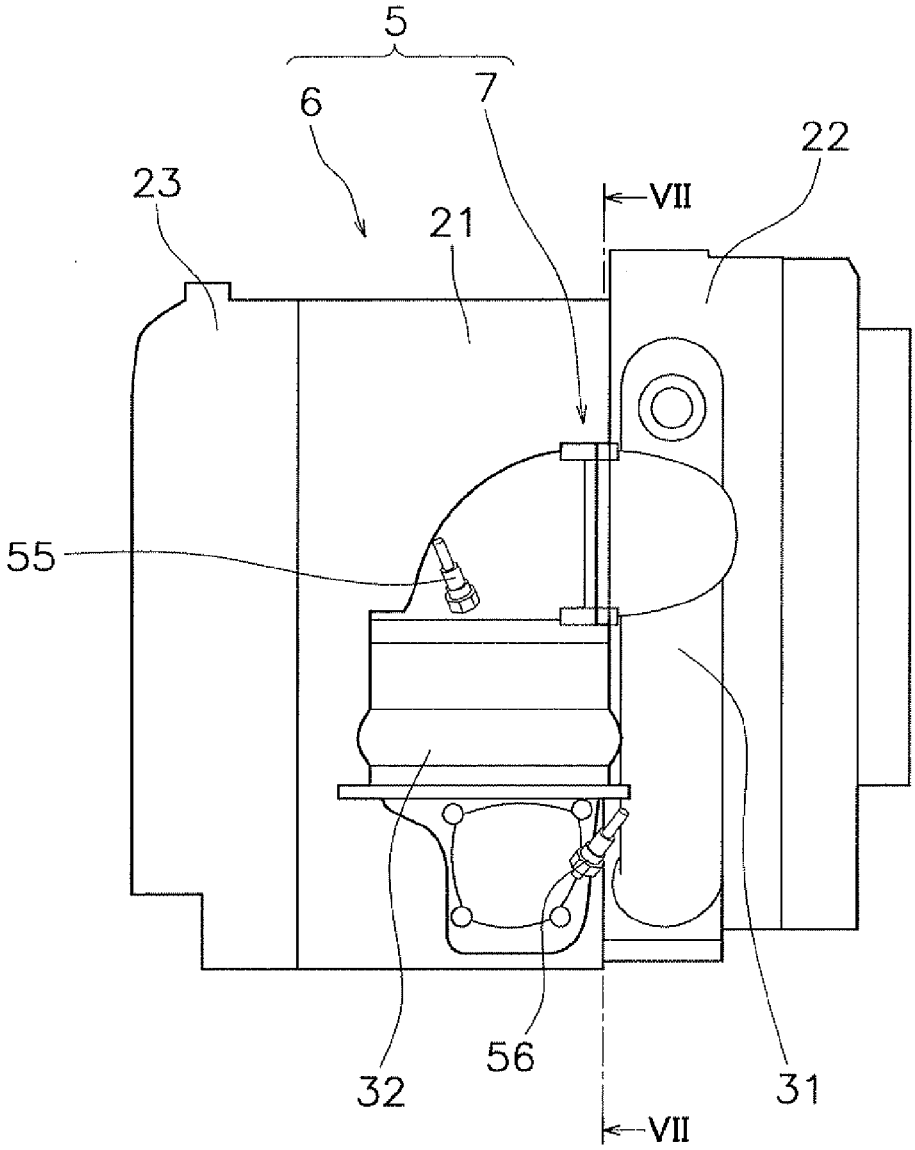
FIG. 3 is a side view of an engine unit according to a preferred embodiment of the present invention.

FIG. 3 is a side view depicting the engine unit 5. The engine 6 includes a cylinder block 21, a cylinder head 22, and a crankcase 23, as shown in FIG. 3.

Figure 4:
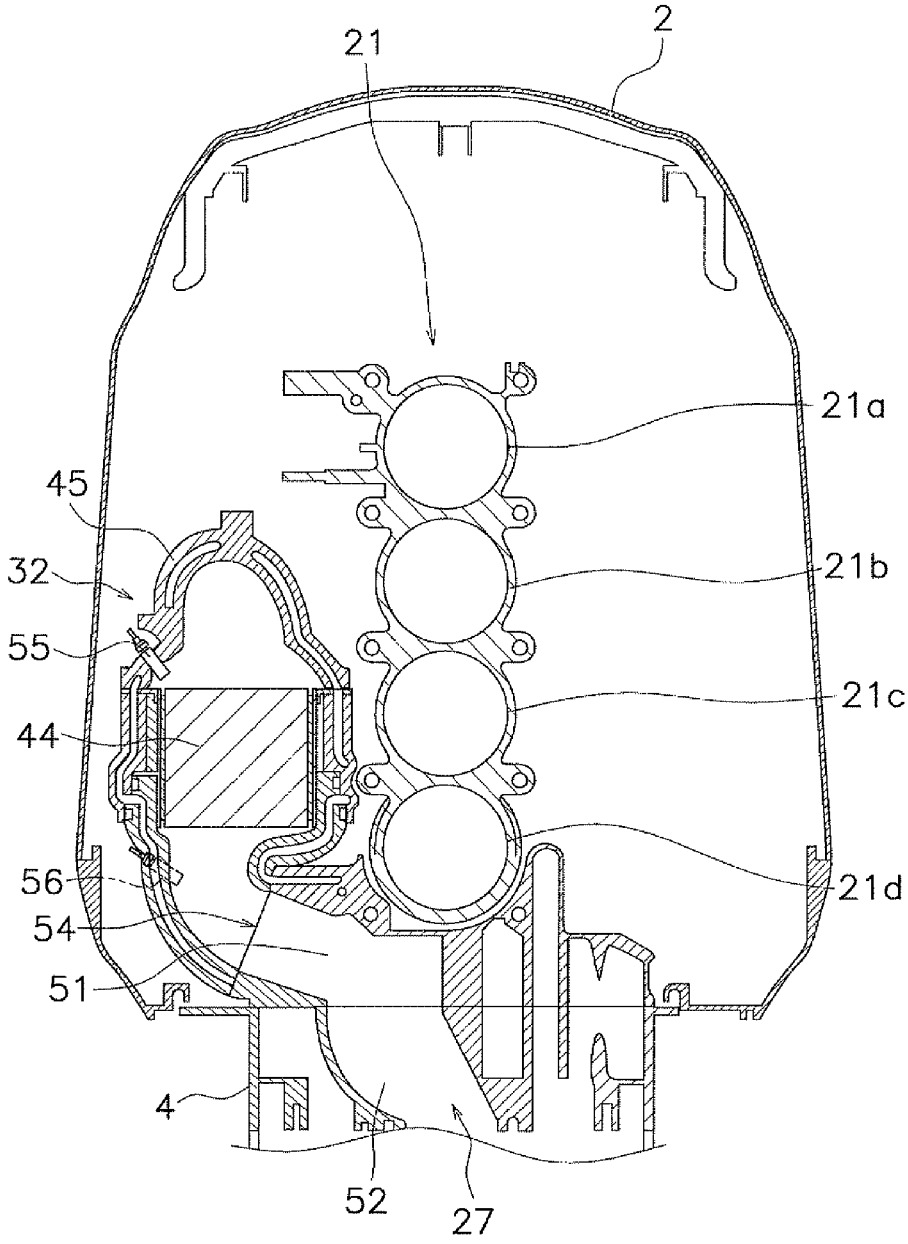
FIG. 4 is a sectional view along line IV-IV in FIG. 1.

The cylinder block 21 is disposed above the exhaust guide portion 4 and is fixed to the exhaust guide portion 4. FIG. 4 is a sectional view of the outboard motor 1 along line IV-IV in FIG. 1. As shown in FIG. 4, the cylinder block 21 preferably includes four cylinders 21*a* to 21*d*, for example. The four cylinders 21*a* to 21*d* are disposed in-line in a vertical direction.

Figure 5:
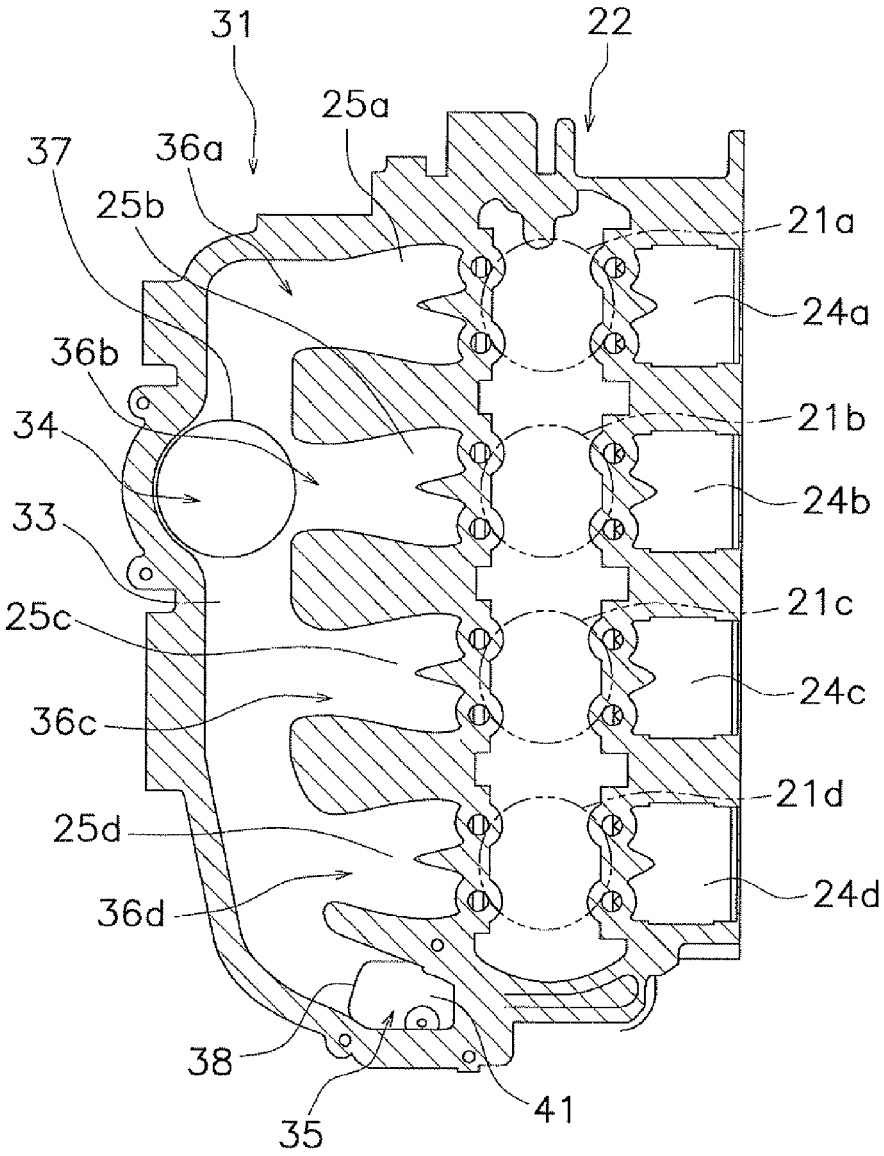
FIG. 5 is a sectional view along line V-V in FIG. 1.

As shown in FIG. 3, the cylinder head 22 is disposed rearward of the cylinder block 21. FIG. 5 is a sectional view of the outboard motor 1 along line V-V in FIG. 1. As shown in FIG. 5, intake ports 24*a* to 24*d* and exhaust ports 25*a* to 25*d* are disposed inside the cylinder head 22. The intake ports 24*a* to 24*d* and the exhaust ports 25*a* to 25*d* are respectively connected to the cylinders 21*a* to 21*d*. The intake ports 24*a* to 24*d* are connected to a fuel supply device, not shown. The exhaust ports 25*a* to 25*d* extend in a lateral direction and are connected to a first passage 33 of a main pipe portion 31, discussed below.

As shown in FIG. 3, the crankcase 23 is disposed forward of the cylinder block 21. The crankshaft 26 (see FIG. 1) is disposed inside the crankcase 23. The crankshaft 26 extends in a vertical direction. The top end portion of the above-described driveshaft 11 is linked to the bottom end portion of the crankshaft 26. The movement of pistons (not shown) disposed inside the cylinders 21*a* to 21*d* is transmitted to the driveshaft 11 via the crankshaft 26.

The exhaust passage 16 preferably includes the exhaust manifold 7 and a lower exhaust passage 27, discussed below. The exhaust gas expelled from the exhaust ports 25*a* to 25*d* amasses in the exhaust manifold 7 and flows into the lower exhaust passage 27. The lower exhaust passage 27 corresponds to the fourth passage according to a preferred embodiment of the present invention. As shown in FIG. 3, the exhaust manifold 7 includes the main pipe portion 31 and a catalyst unit 32.

Figure 6:
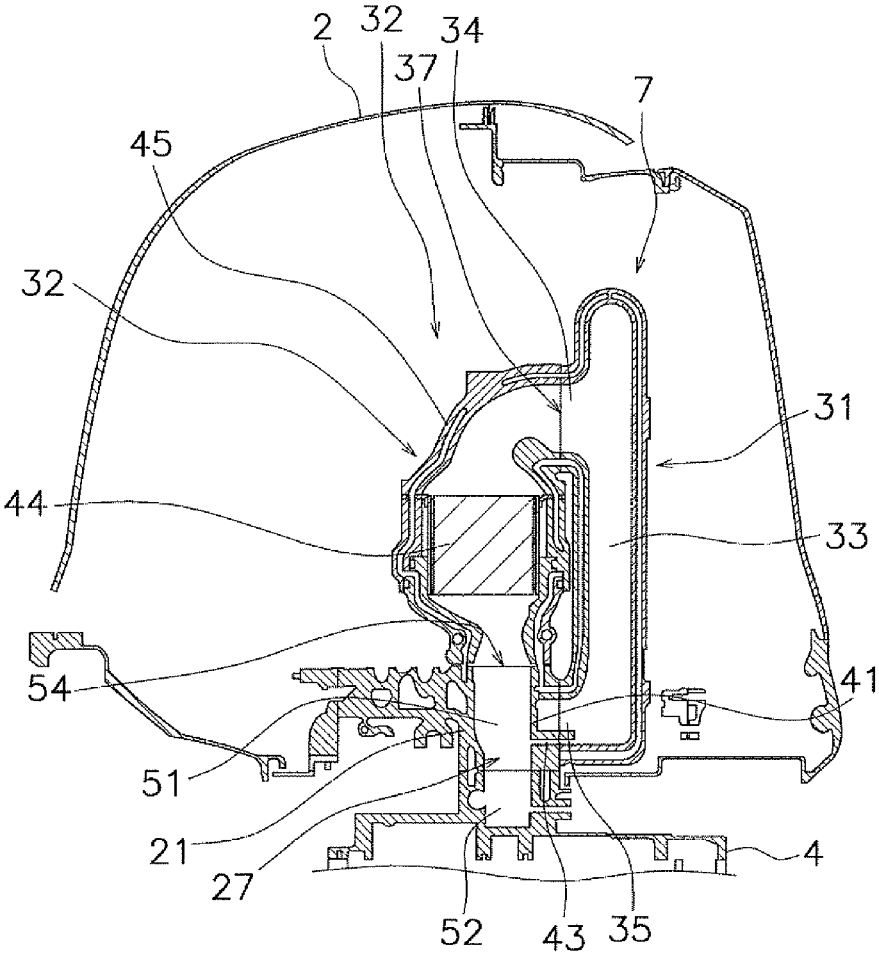
FIG. 6 is a sectional view along line VI-VI in FIG. 2.

The main pipe portion 31 is disposed to the side of the cylinder head 22 and is preferably integral with the cylinder head 22. FIG. 6 is a sectional view along line VI-VI in FIG. 2. As shown in FIG. 6, the main pipe portion 31 includes a first passage 33, a second passage 34, and a third passage 35. The first passage 33 is connected to the above-described plurality of exhaust ports 25*a* to 25*d*. The first passage 33 is disposed to the side of the cylinder head 22 and extends in a vertical direction. As shown in FIG. 5, a plurality of first openings 36*a* to 36*d* are located in the first passage 33, with the first passage 33 and the exhaust ports 25*a* to 25*d* connecting via the first openings 36*a* to 36*d*. The first passage 33 amasses the exhaust gas expelled from the exhaust ports 25*a* to 25*d*.

As shown in FIG. 6, the second passage 34 is connected to the first passage 33. As shown in FIG. 5, the portion connecting the second passage 34 and the first passage 33 is positioned between the top end of the cylinder 21*a* positioned uppermost among the plurality of cylinders 21*a* to 21*d*, and the bottom end of the cylinder 21*d* positioned lowermost among the plurality of cylinders 21*a* to 21*d*. Specifically, the vertical center portion of the portion connecting the second passage 34 and the first passage 33 is positioned above the vertical center portion of the first passage 33. More specifically, the portion connecting the second passage 34 and the first passage 33 is positioned at generally the same height as the cylinder 21*b* that is second from the top among the four cylinders 21*a* to 21*d*. As shown in FIG. 6, the second passage 34 extends in a longitudinal direction from the first passage 33. Consequently, the second passage 34 is approximately parallel to the center axis lines of the cylinders 21*a* to 21*d*. The second passage 34 includes a second opening 37. The catalyst unit 32 is connected to the second opening 37.

Figure 7:
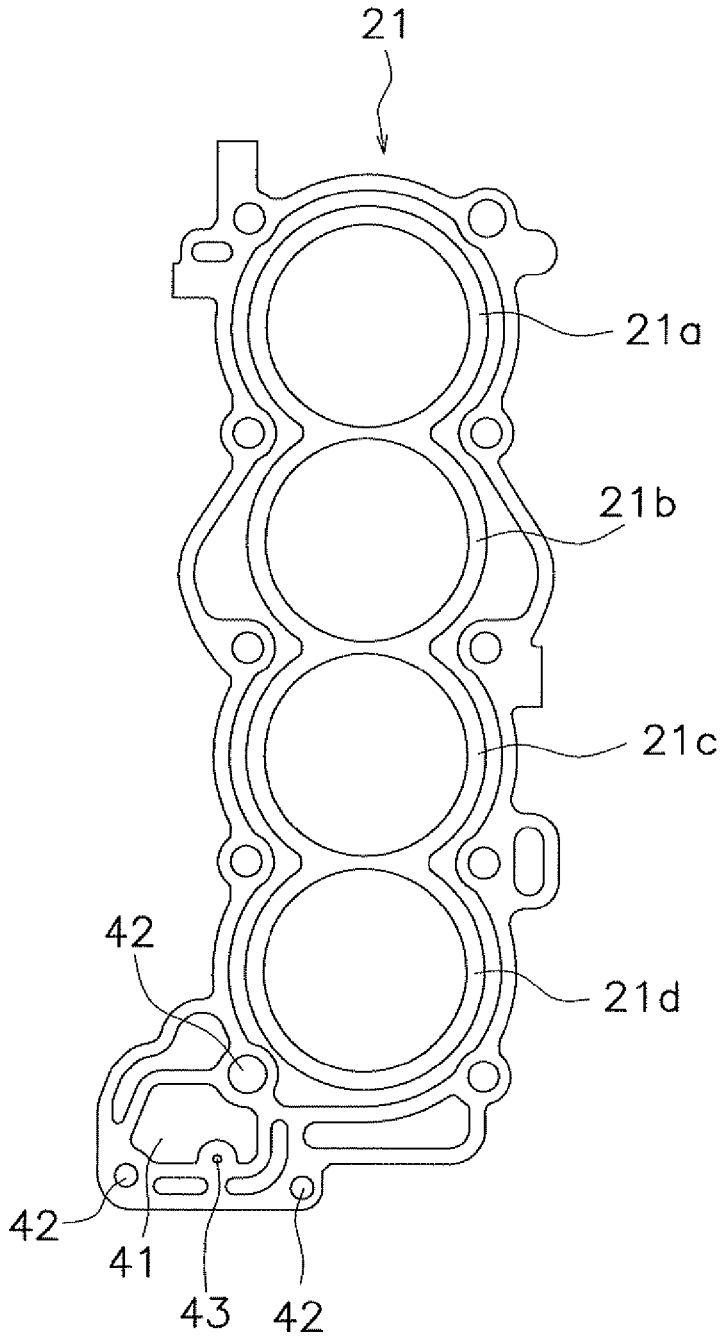
FIG. 7 is a diagram depicting an end surface of a cylinder block in a cross section along line VII-VII in FIG. 3.

As shown in FIGS. 5 and 6, the third passage 35 is connected to the first passage 33 below the second passage 34. The third passage 35 is connected to the bottom end portion of the first passage 33. The third passage 35 extends in a longitudinal direction. The vertical center portion of the third passage 35 is positioned below the vertical center portion of the cylinder 21*d* which is positioned lowermost among the four cylinders 21*a* to 21*d*. The third passage 35 includes a third opening 38. As shown in FIG. 6, the path between the lower exhaust passage 27 and the third passage 35 is obstructed by an obstructing portion 41. FIG. 7 depicts an end surface of the cylinder block 21 in a cross section along line VII-VII of FIG. 3. As shown in FIG. 7, in the present preferred embodiment, the obstructing portion 41 is a wall included in the cylinder block 21. The end portion of the third passage 35 joins with the obstructing portion 41, whereby the third opening 38 is obstructed by the obstructing portion 41. Securing portions 42 for securing the third passage 35 are disposed on the perimeter of the obstructing portion 41. Specifically, the securing portions 42 are screw holes through which bolts are passed. The exhaust manifold 7 is similarly furnished with screw holes, and the exhaust manifold 7 and the cylinder block 21 are fastened with bolts. The third opening 38 is thereby obstructed by the obstructing portion 41.

As shown in FIGS. 6 and 7, a communicating passage 43 is provided in the obstructing portion 41. The communicating passage 43 passes through the obstructing portion 41 and communicates with a first lower passage 51, discussed below. Consequently, the communicating passage 43 causes the third passage 35 and the first lower passage 51 to be in communication. The communicating passage 43 has a cross-sectional area smaller than the cross-sectional area of the third passage 35 and the cross-sectional area of the second opening 37. Because of this, exhaust gas expelled from the third opening 38 is negligible in comparison with the second opening 37. Specifically, the third passage 35 undergoes a process whereby flow of exhaust gas is impeded by the obstructing portion 41 and the communicating passage 43. Condensed water generated inside the first passage flows to the first lower passage 51 via the communicating passage 43. The condensed water then passes through the lower exhaust passage 27 and is expelled to the outside via the propeller boss 13. The communicating passage 43 thus functions as a condensed water removal passage whereby the condensed water generated inside the first passage 33 is removed from the first passage 33.

The catalyst unit 32 shown in FIG. 3 preferably is a separate element from the cylinder head 22 and the cylinder block 21. The catalyst unit 32 is a separate component from the main pipe portion 31. The catalyst unit 32 is disposed to the side of the cylinder block 21. The catalyst unit 32 is attached to the cylinder head 22 and to the main pipe portion 31. As shown in FIG. 6, the catalyst unit 32 is connected to the second passage 34 and the lower exhaust passage 27. Specifically, the second passage 34 is connected to the lower exhaust passage 27 via the catalyst unit 32. The catalyst unit 32 extends downward from the second passage 34. Consequently, the catalyst unit 32 is disposed approximately parallel to the crankshaft 26 (see FIG. 1).

As shown in FIG. 6, the catalyst unit 32 includes a catalyst member 44 and a pipe 45. The catalyst member 44 is disposed inside the pipe 45. The catalyst member 44 preferably includes a catalyst support which supports a catalyst for cleaning exhaust gas. A three-way catalyst, for example, can be used as the catalyst. The catalyst support is preferably made of a cylindrical member having a honeycomb structure, for example. As shown in FIG. 4, the catalyst member 44 is positioned above the bottom end portion of the cylinder 21*d* positioned lowermost among the four cylinders 21*a* to 21*d*. The pipe 45 houses the catalyst member 44. The pipe 45 constitutes portion of the exhaust passage 16, and exhaust gas passing through the exhaust passage 16 is cleaned by transiting through the catalyst member 44 inside the pipe 45.

The lower exhaust passage 27 shown in FIGS. 4 and 6 is a passage through which passes exhaust gas expelled to the outside from the exhaust manifold 7. The lower exhaust passage is connected to the above-described exhaust manifold 7 and catalyst unit 32. The lower exhaust passage 27 guides the exhaust gas from the exhaust ports 25*a* to 25*d* to below the engine 6, and expels the exhaust gas to the outside via the propeller boss 13. The lower exhaust passage 27 includes a first lower passage 51, a second lower passage 52, and a third lower passage 53 (see FIG. 1). The first lower passage 51 is provided inside the cylinder block 21. The first lower passage 51 includes a first lower opening 54. The first lower opening 54 is provided in the lower portion of the side surface of the cylinder block 21. The first lower passage 51 is connected to the catalyst unit 32 via the first lower opening 54. The second lower passage 52 is provided inside the exhaust guide portion 4. The second lower passage 52 is connected to the first lower passage 51. As shown in FIG. 1, the third lower passage 53 is provided inside the lower casing 3. The third lower passage 53 is connected to the second lower passage 52. The third lower passage 53 is also connected to the propeller boss 13.

In the outboard motor 1 according to the present preferred embodiment, exhaust gas from the exhaust ports 25*a* to 25*d* of the engine 6 amasses in the first passage 33 of the exhaust manifold 7. The exhaust gas flows from the first passage 33 through the second passage 34 and into the catalyst unit 32. The exhaust gas is cleaned in the catalyst unit 32. The exhaust gas flows from the catalyst unit 32 into the lower exhaust passage 27. The exhaust gas passes from the lower exhaust passage 27 through the inside of the propeller boss 13, and is expelled to the outside.

As shown in FIGS. 3 and 4, the catalyst unit 32 is preferably provided with a first oxygen sensor 55 and a second oxygen sensor 56 to detect an oxygen concentration in the exhaust gas. The first oxygen sensor 55 is disposed in the exhaust passage 16 upstream from the catalyst member 44. Specifically, the first oxygen sensor 55 is disposed above the catalyst member 44 inside the pipe 45. The second oxygen sensor is disposed in the exhaust passage 16 downstream from the catalyst member 44. Specifically, the second oxygen sensor 56 is disposed below the catalyst member 44 inside the pipe 45. However, the second oxygen sensor 56 is disposed between the communicating passage 43 and the catalyst member 44 inside the pipe 45. Specifically, the second oxygen sensor 56 is disposed downstream from the catalyst member 44 and upstream from the communicating passage 43 in the exhaust passage 16. Detection signals from the first oxygen sensor 55 and the second oxygen sensor 56 are sent to an ECU (not shown). The ECU controls the engine 6 on the basis of detection values from the first oxygen sensor 55 and the second oxygen sensor 56.

Next, a method for manufacturing the engine unit 5 is described. Here, particular description is made of the steps for constructing portion of the exhaust passage 16 in the engine unit 5, while a description of other manufacturing steps is omitted.

Figure 8A:
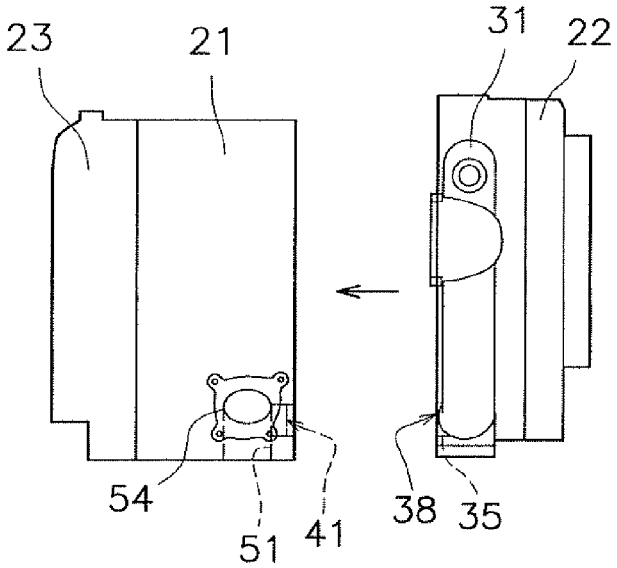
FIGS. 8A-8C are diagrams depicting a portion of the manufacturing steps for a catalyst-equipped engine unit according to a preferred embodiment of the present invention.
Figure 8B:
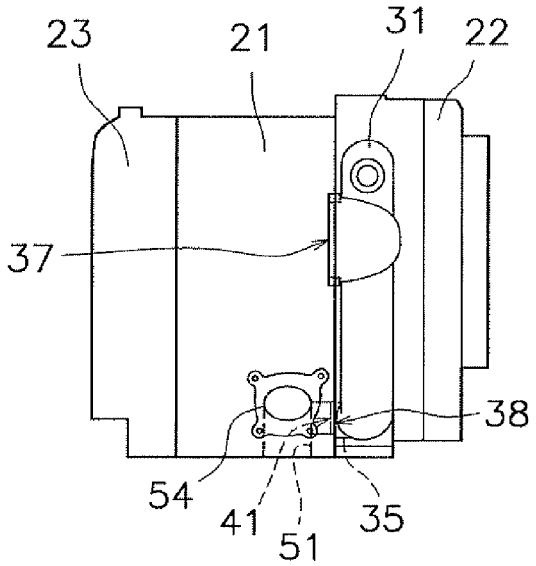

First, as shown in FIG. 8A, the cylinder head 22 is attached to the cylinder block 21. At this time, the third opening 38 of the third passage 35 is connected to the obstructing portion 41 of the cylinder block 21. In so doing, the third passage 35 is obstructed by the obstructing portion 41 as shown in FIG. 8B. Specifically, the third passage 35 is subjected to a process for impeding flow of exhaust gas.

Figure 8C:
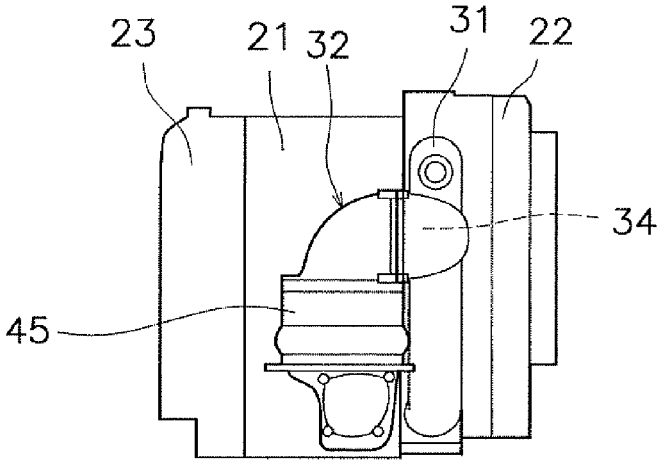

Next, as shown in FIG. 8C, the catalyst unit 32 is attached to the main pipe portion 31 and the cylinder block 21. Here, the top end of the pipe 45 of the catalyst unit 32 is connected to the second opening 37 of the main pipe portion 31. Also, the bottom end of the pipe 45 is connected to the first lower opening 54 of the cylinder block 21. In so doing, the second passage 34 is connected to the first lower passage 51 via the catalyst unit 32. Specifically, the second passage 34 is connected to the lower exhaust passage 27 via the catalyst unit 32.

Through the preceding steps, an engine unit 5 provided with the above-described catalyst unit 32 (herein called a "catalyst-equipped engine unit 5") is manufactured. Here, in the outboard motor 1 according to the present preferred embodiment, through modification of a portion of the manufacturing steps of the above-described engine unit 5, an engine unit not equipped with the catalyst unit 32 (herein called a "non-catalyst-equipped engine unit 5'") can be manufactured using the same engine 6 in common with the catalyst-equipped engine unit 5. The manufacturing steps of the non-catalyst-equipped engine unit 5' are described below.

Figure 9:
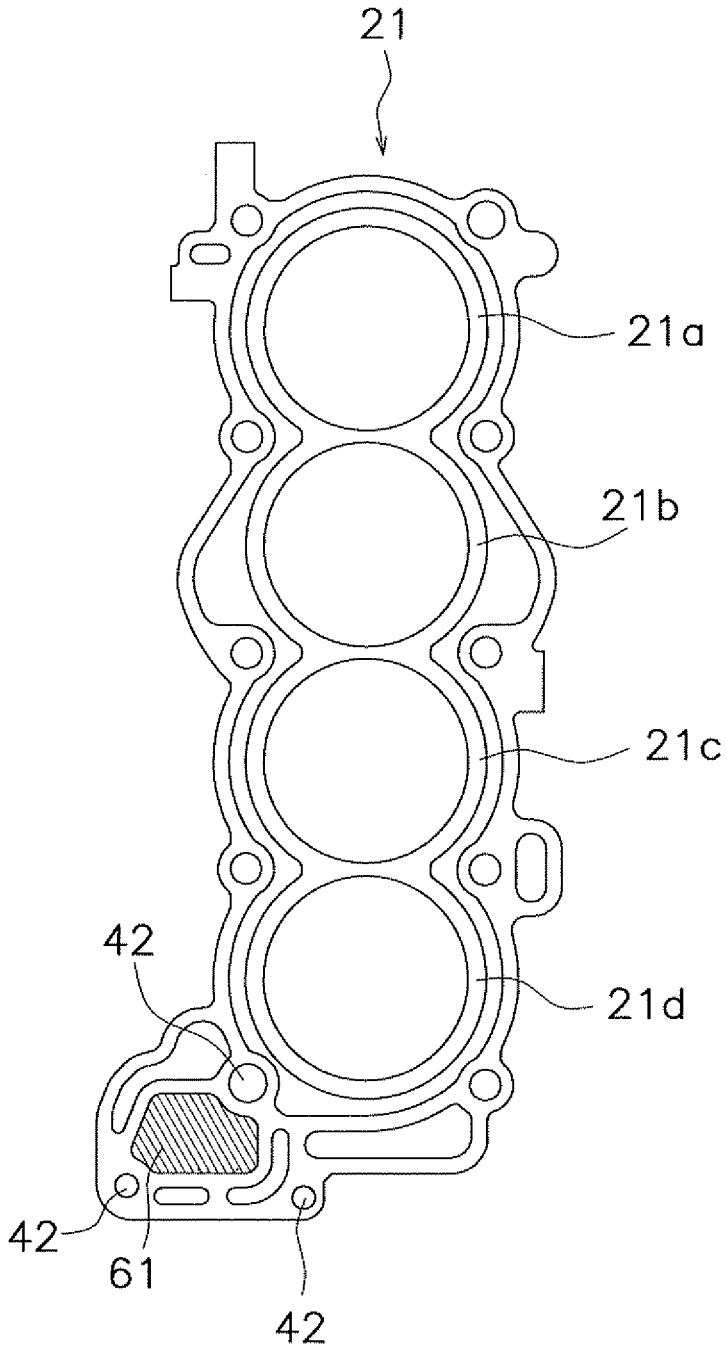
FIG. 9 is a diagram depicting a portion of the manufacturing steps for a catalyst-equipped engine unit according to a preferred embodiment of the present invention.
Figure 10A:
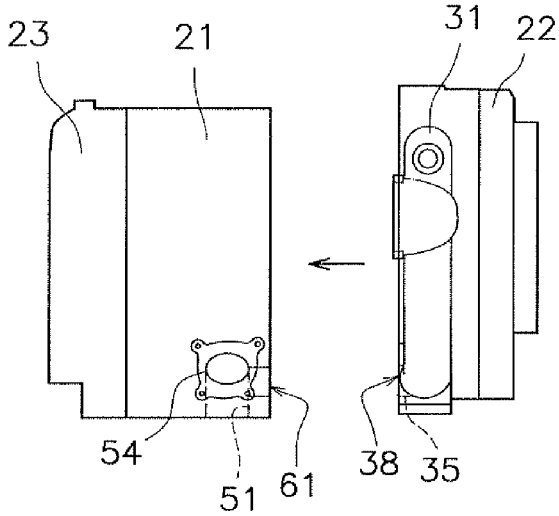
FIGS. 10A-10C are diagrams depicting a portion of the manufacturing steps for a non-catalyst-equipped engine unit according to a preferred embodiment of the present invention.
Figure 10B:
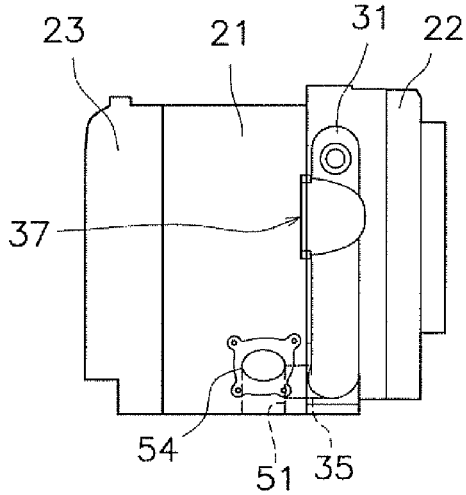

First, as shown in FIG. 9, a hole-boring process is performed at a position corresponding to the obstructing portion of the cylinder block 21 (see FIG. 7). In FIG. 9, to facilitate understanding, the section in which the hole-boring process was performed is indicated by hatching. Here, a hole (herein called a "second lower opening 61") having an opening area larger than that of the above-described communicating passage 43 has been formed at a position corresponding to the obstructing portion 41 of the cylinder block 21. Next, as shown in FIG. 10A, the cylinder head 22 is attached to the cylinder block 21. At this time, the third opening 38 of the third passage 35 is connected at the position corresponding to the obstructing portion 41 of the cylinder block 21, at which position the second lower opening 61 has been formed. Therefore, the third opening 38 is connected to the second lower opening 61 of the cylinder block 21. In so doing, the third passage 35 is connected to the first lower passage 51 as shown in FIG. 10B. Specifically, the third passage 35 is connected to the lower exhaust passage 27.

Figure 10C:
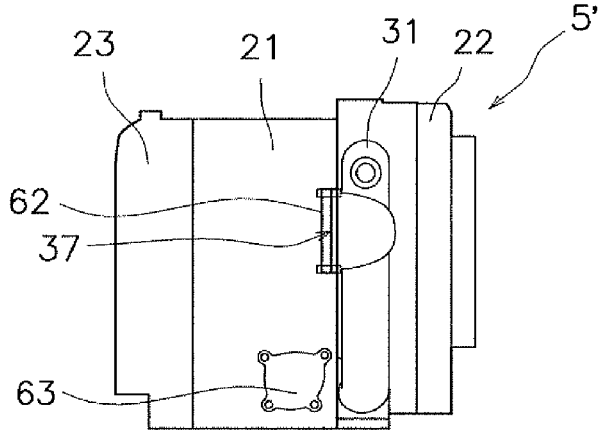

Next, as shown in FIG. 10C, a first cover 62 is attached to the second opening 37 of the main tube section 31. The second opening 37 is thereby obstructed by the first cover 62. Specifically, the second passage 34 is subjected to a process for impeding flow of exhaust gas. A second cover 63 is attached to the first lower opening 54 of the cylinder block 21. The first lower opening 54 is thereby obstructed by the second cover 63.

Figure 11:
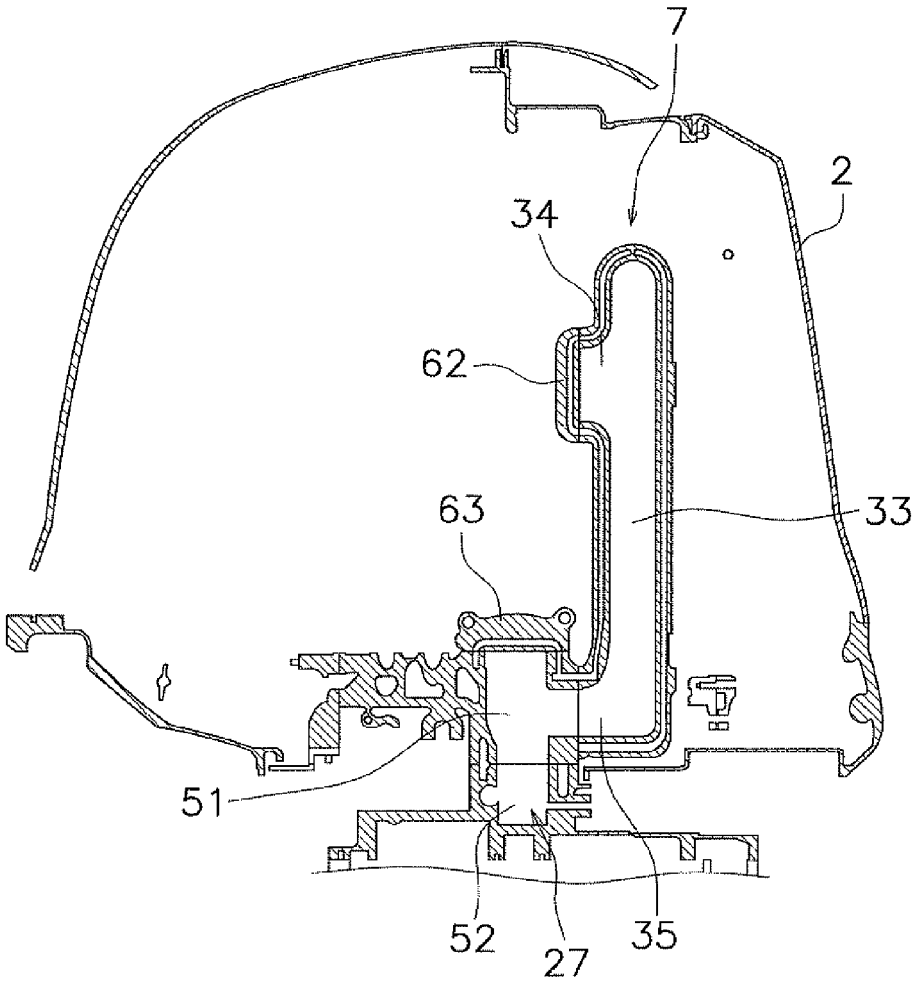
FIG. 11 is a sectional view depicting a configuration of an exhaust passage of a non-catalyst-equipped engine unit according to a preferred embodiment of the present invention.

FIG. 11 is a sectional view depicting the configuration of the exhaust passage of the non-catalyst-equipped engine unit 5'. In the outboard motor 1 provided with the non-catalyst-equipped engine unit 5', exhaust gas from the engine 6 is expelled to the outside in the following manner. Exhaust gas from the exhaust ports 25*a* to 25*d* of the engine 6 is amassed in the first passage 33 of the exhaust manifold 7. The exhaust gas flows from the first passage 33, through the third passage 35 and the first lower passage 51, and into the second lower passage 52. The exhaust gas then flows through the third lower passage 53 and the inside of the propeller boss 13 shown in FIG. 1, and is expelled to the outside. Because the third passage 35 is connected to the lower portion of the first passage 33, condensed water generated in the first passage 33 flows through the third passage 35 and into the lower exhaust passage 27. Consequently, backflow of condensed water to the engine 6 can be minimized in the non-catalyst-equipped engine unit 5' as well.

In the outboard motor 1 according to the present preferred embodiment, the first passage 33 in which the exhaust gas amasses is connected to the second passage 34 and to the third passage 35. Because of this, the catalyst-equipped engine unit 5 can be manufactured by connecting the second passage 34 to the lower exhaust passage 27 via the catalyst unit 32. Alternatively, the non-catalyst-equipped engine unit 5' can be manufactured by connecting the third passage 35 to the lower exhaust passage 27. Consequently, the same engine 6 can be utilized in common in manufacturing both the catalyst-equipped model of the outboard motor 1 and the non-catalyst-equipped model of the outboard motor 1. In the non-catalyst-equipped engine unit 5', the entire catalyst unit 32, including not only the catalyst member 44 but the pipe 45 as well, can be omitted, as compared with the catalyst-equipped engine unit 5. The weight of the non-catalyst-equipped outboard motor can thereby be appreciably reduced as compared with the catalyst-equipped type outboard motor 1.

During manufacture of the catalyst-equipped engine unit 5 and the non-catalyst-equipped engine unit 5', the processes necessary for using the same engine 6 in common are those for attaching the covers 62, 63, and for boring a hole in the obstructing portion 41. Because of this, during manufacture of the catalyst-equipped engine unit 5 and the non-catalyst-equipped engine unit 5', the same engine 6 can be utilized in common with only slight modification.

In the catalyst-equipped engine unit 5, the catalyst member 44 is disposed to the side of the engine 6. Consequently, because the catalyst member 44 can be disposed at an elevated position, exposure of the catalyst member 44 to water can be minimized.

In the catalyst-equipped engine unit 5, condensed water generated in the first passage 33 flows through the third passage 35 and the communicating passage 43, and into the lower exhaust passage 27. Because of this, backflow of condensed water from the first passage 33 to the exhaust ports 25*a* to 25*d* can be minimized. Also, because the flow of condensed water through the second passage into the catalyst unit 32 is minimized, exposure of the first oxygen sensor 55 to water can be minimized. Further, because the communicating passage 43 communicates with the first lower passage 51 positioned downstream from the catalyst member 44 and the second oxygen sensor 56, exposure of the second oxygen sensor 56 to condensed water can be minimized. In so doing, the reliability of the first oxygen sensor 55 and the second oxygen sensor 56 can be improved. Also, because exposure of the catalyst member 44 to water is minimized, degradation of the catalyst member 44 can be minimized.

While one preferred embodiment of the present invention has been described hereinabove, the present invention is not limited thereto. Various modifications and combinations of various preferred embodiments of the present invention are possible without departing from the spirit of the present invention.

The number of cylinders is not limited to four. The number of cylinders may be three or fewer. Alternatively, the number of cylinders may be five or more.

The main pipe portion 31 may be a component separate from the cylinder head 22. Some or all of the first passage 33, the second passage 34, and the third passage 35 included in the main pipe portion 31 may be separate components.

The obstructing portion 41 may be furnished to the main pipe portion 31. Alternatively, the obstructing portion 41 may be provided as a member which is a separate element from the main pipe portion 31 and the cylinder block 21, and disposed between the third passage 35 and the first lower passage 51.

Figures 12A, 12B:
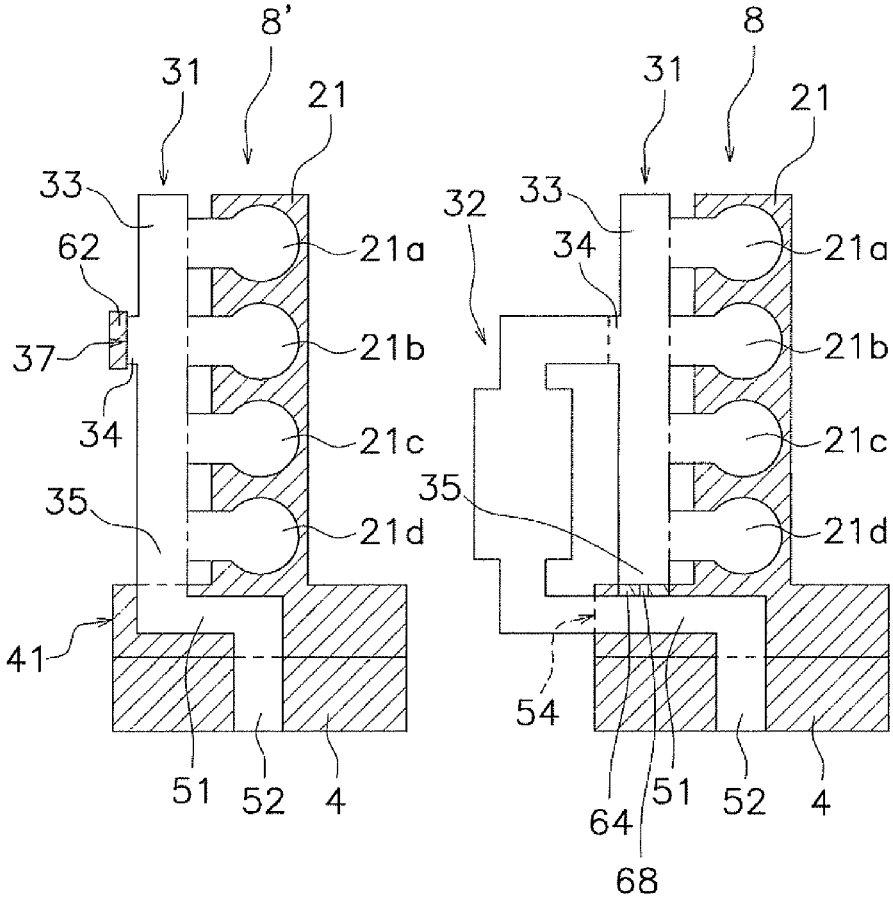
FIGS. 12A and 12B are diagrams schematically depicting a configuration of an exhaust passage of an engine unit according to another preferred embodiment of the present invention.

In the preferred embodiment described above, the first lower opening 54 which communicates with the first lower passage is provided in the cylinder block 21. Then, during manufacture of the non-catalyst-equipped engine unit 5', the first lower opening 54 is closed off by the second cover 63. However, as shown in FIG. 12A, during manufacture of a non-catalyst-equipped engine unit 8', rather than the first lower opening 54 being provided in the cylinder block 21, instead, the first lower passage 51 may be closed off by the obstructing portion 41 provided in an integrated fashion with the cylinder block 21. In this case, as shown in FIG. 12B, during manufacture of a catalyst-equipped engine unit 8, the first lower opening 54 is formed by a process of boring a hole at a position corresponding to the obstructing portion 41 of the cylinder block 21. The lower opening of the catalyst unit 32 is then connected to the first lower opening 54. In the non-catalyst-equipped engine unit 8' shown in FIG. 12A, the second passage 34 undergoes a process to impede the flow of exhaust gas. For example, the second passage 34 is blocked by the first cover in a manner analogous to the preferred embodiment described above. In the catalyst-equipped engine unit 8 shown in FIG. 12B, the third passage 35 undergoes a process to impede the flow of exhaust gas. For example, the third passage 35 is blocked by a plug 64. The plug 64 is furnished with a communicating passage for removing condensed water in similar fashion to the communicating passage 43 discussed above. FIG. 12A schematically depicts the configuration of the exhaust passage of the non-catalyst-equipped engine unit 8'. FIG. 12B schematically depicts the configuration of the exhaust passage of the catalyst-equipped engine unit 8.

Figures 13A, 13B:
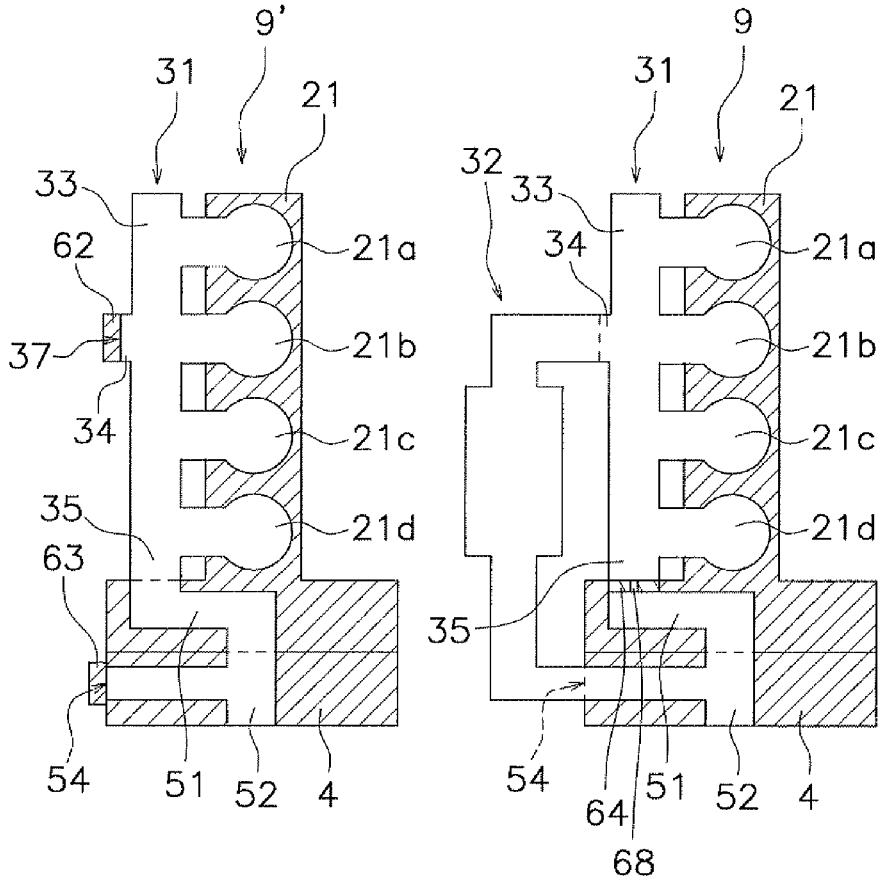
FIGS. 13A and 13B are diagrams schematically depicting a configuration of an exhaust passage of an engine unit according to another preferred embodiment of the present invention.

In the preferred embodiment described above, the first lower opening 54 is provided in the cylinder block 21, but the position of the first lower opening 54 is not limited thereto. For example, as shown in FIGS. 13A and 13B, the first lower opening 54 may be provided in the exhaust guide portion 4. Specifically, the second lower passage 52, not the first lower passage 51, may have the first lower opening 54. FIG. 13A schematically depicts the configuration of the exhaust passage of a non-catalyst-equipped engine unit 9'. FIG. 13B schematically depicts the configuration of the exhaust passage of a catalyst-equipped engine unit 9. In this case, as shown in FIG. 13A, in the non-catalyst-equipped engine unit 9', the third passage 35 is connected to the first lower passage 51. As shown in FIG. 13B, in the catalyst-equipped engine unit 9, the second passage 34 is connected to the second lower passage 52 via the catalyst unit 32. In the non-catalyst-equipped engine unit 9' shown in FIG. 13A, the second passage 34 undergoes a process to impede the flow of exhaust gas. For example, the second passage 34 may be blocked by the first cover 62 in a manner analogous to the preferred embodiment described above. In the catalyst-equipped engine unit 9 shown in FIG. 13B, the third passage 35 undergoes a process to impede the flow of exhaust gas. For example, the third passage 35 may be blocked by a plug 64. The plug 64 is furnished with a communicating passage 68 to remove condensed water in similar fashion to the communicating passage 43 discussed above.

In the preferred embodiment described above, the first lower passage 51 is preferably provided inside the cylinder block 21, but may be provided in a member that is a separate element from the cylinder block 21. Also, the first lower passage 51 may be provided in a member that is a separate element from the first passage 33. The same applies to the first lower passage 51 of the engine units shown in FIGS. 12A, 12B, 13A and 13B as well.

Figures 14A, 14B:
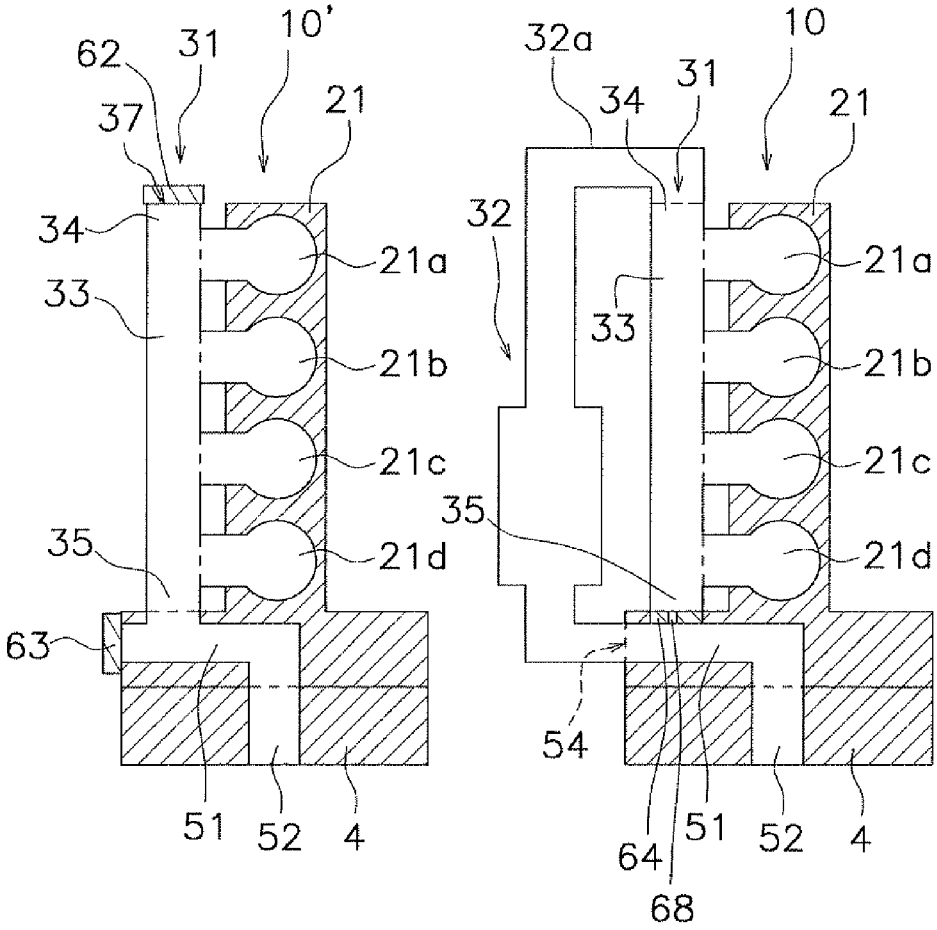
FIGS. 14A and 14B are diagrams schematically depicting a configuration of an exhaust passage of an engine unit according to another preferred embodiment of the present invention.

In the preferred embodiment described above, the second passage 34 preferably extends in a longitudinal direction from the first passage 33, but may extend upward from the first passage 33 as shown in FIGS. 14A and 14B. In this case, the catalyst unit 32 would include a pipe 32*a* which is positioned at least in portion above the cylinder block 21. FIG. 14A schematically depicts the configuration of the exhaust passage of a non-catalyst-equipped engine unit 10'. FIG. 14B schematically depicts the configuration of the exhaust passage of a catalyst-equipped engine unit 10. In the non-catalyst-equipped engine unit 10' shown in FIG. 14A, the second passage 34 undergoes a process to impede the flow of exhaust gas. For example, the second passage 34 may be blocked by the first cover in a manner analogous to the preferred embodiment described above. In the catalyst-equipped engine unit 10 shown in FIG. 14B, the third passage 35 undergoes a process to impede the flow of exhaust gas. For example, the third passage 35 may be blocked by a plug 64. The plug 64 is provided with a communicating passage 68 to remove condensed water in similar fashion to the communicating passage 43 discussed above.

Figure 15A:
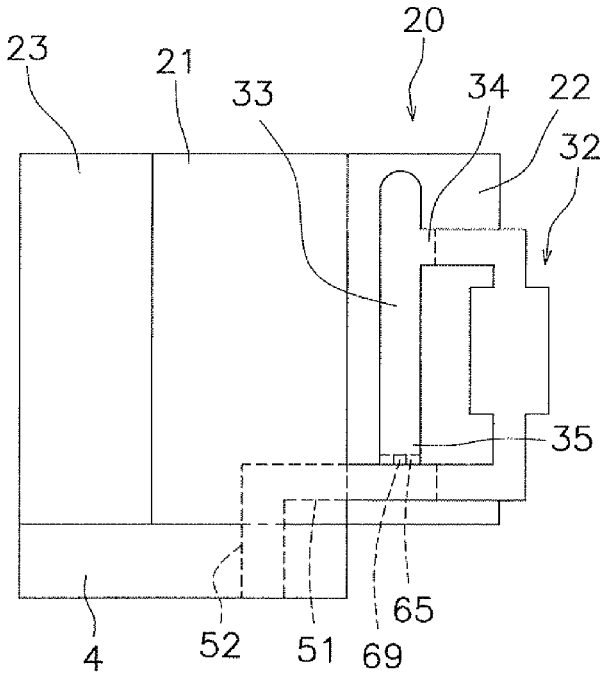
FIGS. 15A and 15B are diagrams schematically depicting a configuration of an exhaust passage of an engine unit according to another preferred embodiment of the present invention.
Figure 15B:
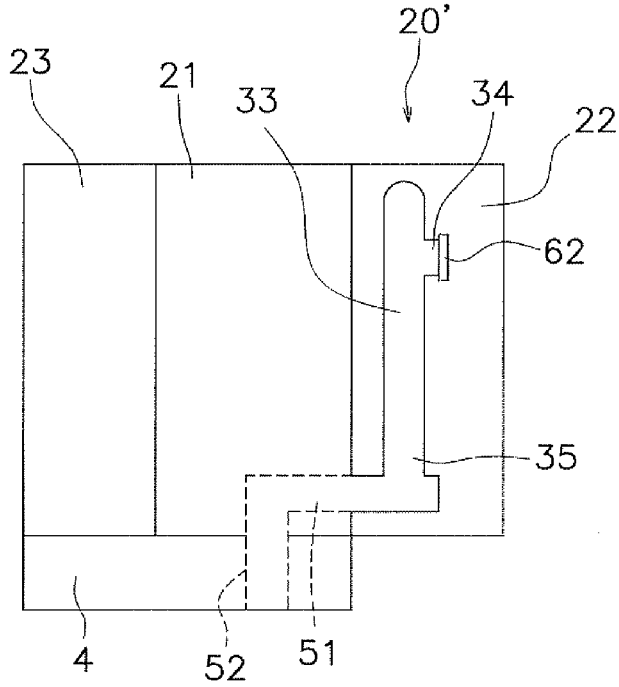

In the preferred embodiment described above, the catalyst unit 32 preferably is positioned forward of the first passage 33, but may be positioned rearward of the first passage as shown in FIGS. 15A and 15B. Specifically, the catalyst unit 32 may be disposed to the side of the cylinder head 22. FIG. 15A schematically depicts the configuration of the exhaust passage of a catalyst-equipped engine unit 20. FIG. 15B schematically depicts the configuration of the exhaust passage of a non-catalyst-equipped engine unit 20'. In the catalyst-equipped engine unit 20 shown in FIG. 15A, the third passage 35 undergoes a process to impede the flow of exhaust gas. For example, the third passage 35 may be blocked by a stopper 65. The stopper 65 is furnished with a communicating passage 69 to remove condensed water in similar fashion to the communicating passage 43 discussed above. In the non-catalyst-equipped engine unit 20' shown in FIG. 15B, the second passage 34 undergoes a process to impede the flow of exhaust gas. For example, the second passage 34 may be blocked by the first cover 62 in a manner analogous to the preferred embodiment described above.

Figure 16A:
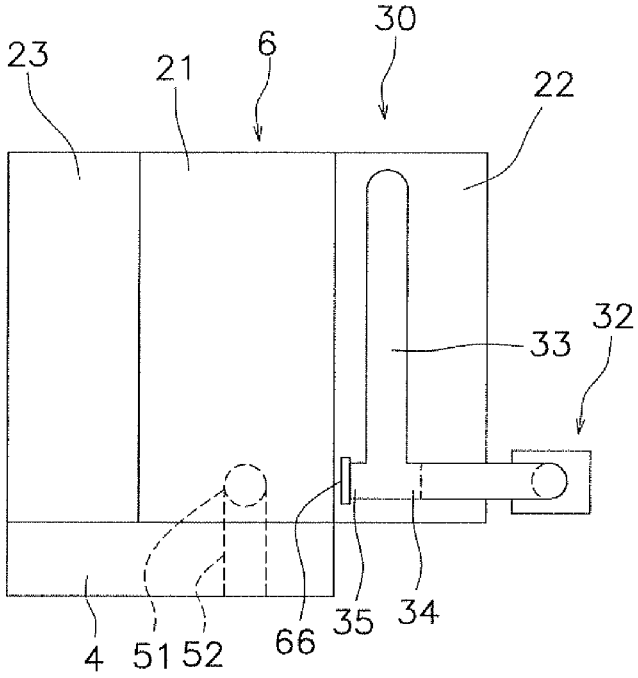
FIGS. 16A and 16B are diagrams schematically depicting a configuration of an exhaust passage of an engine unit according to another preferred embodiment of the present invention.
Figure 16B:
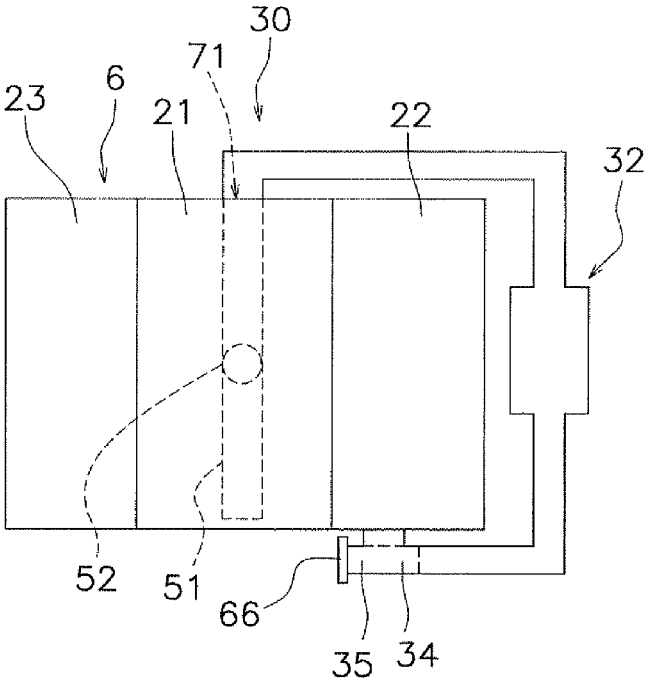
Figure 17A:
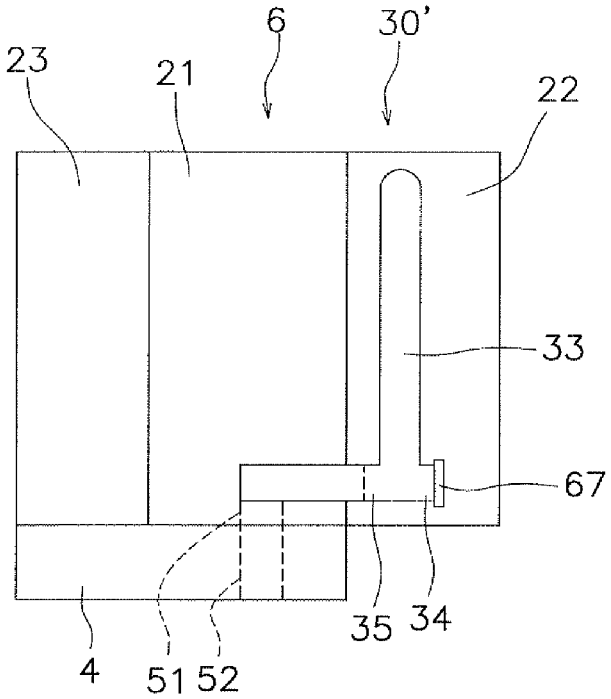
FIGS. 17A and 17B are diagrams schematically depicting a configuration of an exhaust passage of an engine unit according to another preferred embodiment of the present invention.
Figure 17B:
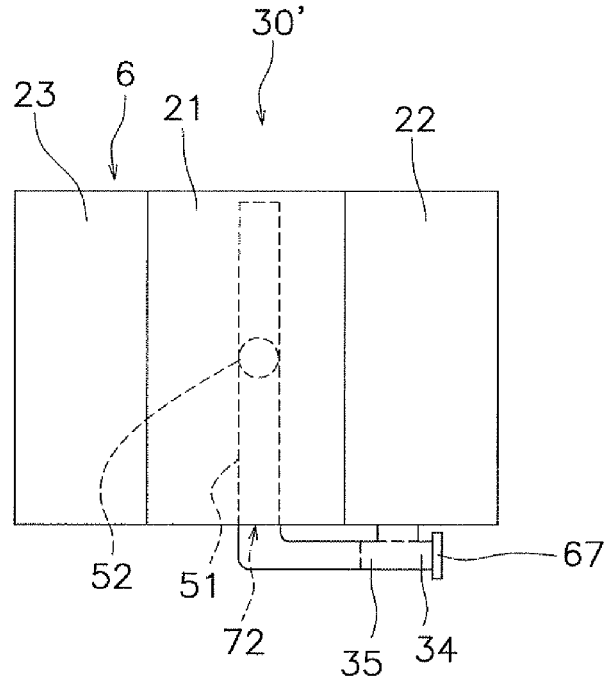

In the preferred embodiment described above, the second passage 34 and the third passage 35 extend in the same direction from the first passage 33, but may extend in different directions. For example, as shown in FIGS. 16A, 16B, 17A and 17B, the third passage 35 may extend forward from the first passage 33, while the second passage 34 extends rearward from the first passage 33. FIG. 16A is a side view schematically depicting the configuration of the exhaust passage of a catalyst-equipped engine unit 30. FIG. 16B is a plan view schematically depicting the configuration of the exhaust passage of the catalyst-equipped engine unit 30. FIG. 17A is a side view schematically depicting the configuration of the exhaust passage of a non-catalyst-equipped engine unit 30'. FIG. 17B is a plan view schematically depicting the configuration of the exhaust passage of the non-catalyst-equipped engine unit 30'. In the catalyst-equipped engine unit 30 shown in FIGS. 16A and 16B, the catalyst unit 32 is disposed in-line with the engine 6 in a longitudinal direction. Specifically, the catalyst unit 32 is disposed rearward of the cylinder head 22. The catalyst unit extends in the lateral direction of the catalyst-equipped engine unit 30. The catalyst unit 32 is connected to a first lower opening 71 provided on a side surface of the cylinder block 21. The third passage 35 undergoes a process to impede the flow of exhaust gas. For example, the third passage 35 may be blocked by a cover 66. In the non-catalyst-equipped engine unit 30' shown in FIGS. 17A and 17B, the second passage 34 undergoes a process to impede the flow of exhaust gas. For example, the second passage 34 may be blocked by a cover 67. The third passage 35 is connected to a second lower opening 72 provided in the cylinder block 21. The second lower opening 72 is provided on a side surface to the opposite side from the first lower opening 71 in the cylinder block 21.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a plurality of cylinders disposed in-line in a vertical direction, and a plurality of exhaust ports respectively connected to the plurality of cylinders;

an exhaust manifold including a first passage connected to the plurality of exhaust ports and extending in the vertical direction, a second passage connected to the first passage, and a third passage directly connected to the first passage below the second passage; and a fourth passage connected to the exhaust manifold and through which exhaust gas is expelled to outside from the exhaust manifold; wherein one of the second passage and the third passage is connected to the fourth passage, and the other of the second passage and the third passage includes a structure that impedes flow of exhaust gas.

2. The outboard motor according to claim 1, wherein an opening is provided in the first passage, with the first passage and the exhaust ports being connected via the opening.

3. The outboard motor according to claim 1, wherein the exhaust manifold includes a catalyst unit which includes a catalyst to clean exhaust gas and a pipe housing the catalyst, and the second passage is connected to the fourth passage via the catalyst unit.

4. The outboard motor according to claim 1, wherein the third passage is connected to a bottom end portion of the first passage, and a communicating passage having a cross-sectional area smaller than a cross-sectional area of the third passage is located between the fourth passage and the third passage such that the third passage impedes the flow of exhaust gas.

5. The outboard motor according to claim 3, wherein the catalyst unit includes an oxygen sensor disposed between the communicating passage and the catalyst inside the pipe.

6. The outboard motor according to claim 1, wherein an opening is provided in the third passage, the third passage and the fourth passage are connected via the opening, and the second passage includes a structure that impedes flow of exhaust gas.

7. The outboard motor according to claim 6, wherein the structure that impedes flow of exhaust gas provided in the second passage includes a cover member arranged to cover the second passage.

8. A method for manufacturing an outboard motor including an engine including a plurality of cylinders disposed in-line in a vertical direction, and a plurality of exhaust ports respectively connected to the plurality of cylinders, an exhaust manifold including a first passage connected to the plurality of exhaust ports and extending in the vertical direction, a second passage connected to the first passage, and a third passage directly connected to the first passage below the second passage, and a fourth passage connected to the exhaust manifold and through which exhaust gas is expelled to the outside from the exhaust manifold, the method for manufacturing the outboard motor comprising:

a first step in which one of the second passage and the third passage is connected to the fourth passage; and a second step in which the other of the second passage and the third passage is subjected to a process for impeding flow of exhaust gas.

9. An outboard motor comprising:

an engine including a plurality of cylinders disposed in-line in a vertical direction, and a plurality of exhaust ports respectively connected to the plurality of cylinders;

an exhaust manifold including a first passage connected to the plurality of exhaust ports and extending in the vertical direction, a second passage connected to the first passage, and a third passage directly connected to the first passage; and a fourth passage connected to the exhaust manifold and through which exhaust gas is expelled to outside from the exhaust manifold; wherein one of the second passage and the third passage is connected to the fourth passage, while the other of the second passage and the third passage includes a structure that impedes flow of exhaust gas.

10. The outboard motor according to claim 9, wherein the third passage is connected to a bottom end portion of the first passage, and a communicating passage having a cross-sectional area smaller than a cross-sectional area of the third passage is provided between the fourth passage and the third passage such that the third passage impedes the flow of exhaust gas.

11. The outboard motor according to claim 9, wherein the exhaust manifold further includes a catalyst unit which includes a catalyst to clean exhaust gas and a pipe housing the catalyst, and the second passage is connected to the fourth passage via the catalyst unit.

12. The outboard motor according to claim 11, wherein the catalyst unit includes an oxygen sensor disposed between the communicating passage and the catalyst inside the pipe.

13. The outboard motor according to claim 9, wherein the second passage extends from the first passage in a direction opposite to the third passage.

14. The outboard motor according to claim 13, wherein the exhaust manifold further includes a catalyst unit which includes a catalyst to clean exhaust gas and a pipe housing the catalyst; the second passage is connected to the fourth passage via the catalyst unit; the engine includes a cylinder head, a crankcase, and a cylinder block which includes the plurality of cylinders; the cylinder block, the cylinder head, and the crankcase are disposed in-line in a first direction; and the catalyst unit is disposed in-line with the engine in the first direction.

* * * * *